US007789459B1

(12) United States Patent
Rodriguez et al.

(10) Patent No.: US 7,789,459 B1
(45) Date of Patent: Sep. 7, 2010

(54) OCTAGONAL PATIO PICNIC TABLE WITH ACCESSORIES

(76) Inventors: Adriana Rodriguez, 3897 State Road 64 E., Wauchula, FL (US) 33873; Victor Rodriguez, 3897 State Road 64 E., Wauchula, FL (US) 33873

( * ) Notice: Subject to any disclaimer, the term of this patent is extended or adjusted under 35 U.S.C. 154(b) by 167 days.

(21) Appl. No.: 12/074,743

(22) Filed: Mar. 6, 2008

Related U.S. Application Data

(60) Provisional application No. 60/905,060, filed on Mar. 6, 2007.

(51) Int. Cl.
*A47B 83/02* (2006.01)

(52) U.S. Cl. ..... 297/158.3

(58) Field of Classification Search ..... 297/184.1, 297/157.1, 158.1, 158.2, 158.3, 158.4, 158.5; D6/335, 337; 52/82, 202.2, 202.7; 108/50.12; 135/91, 96; D25/17, 56
See application file for complete search history.

(56) References Cited

U.S. PATENT DOCUMENTS

| | | | | |
|---|---|---|---|---|
| 2,713,889 | A * | 7/1955 | White | 297/158.3 |
| 3,542,420 | A * | 11/1970 | Priewe | 297/158.3 |
| D233,497 | S | 11/1974 | Zelkowitz | |
| D237,563 | S | 11/1975 | Gerber et al. | |
| D239,843 | S | 5/1976 | Freeman | |
| D241,999 | S | 10/1976 | Carter | |
| D250,684 | S | 1/1979 | Van Sant | |
| D258,029 | S | 1/1981 | Redmond | |
| D262,845 | S | 2/1982 | Keller | |
| 4,569,555 | A * | 2/1986 | Lehman | 297/141 |
| 4,635,614 | A | 1/1987 | Segroves | |
| 5,027,718 | A | 7/1991 | Graham, Sr. | |
| 5,335,803 | A | 8/1994 | O'Brien et al. | |
| 5,493,976 | A | 2/1996 | Hammond | |
| D378,479 | S | 3/1997 | Smith | |
| 5,720,512 | A * | 2/1998 | Hostetler | 297/158.5 |
| 5,803,265 | A | 9/1998 | Bergerman | |
| D411,927 | S | 7/1999 | Van Rhienen | |
| D429,903 | S * | 8/2000 | Iannaccone | D6/337 |
| 6,490,981 | B2 * | 12/2002 | Isensee et al. | 108/50.02 |
| 6,612,713 | B1 * | 9/2003 | Kuelbs | 362/102 |
| 6,773,140 | B2 * | 8/2004 | Lee | 362/249.16 |
| 7,044,064 | B2 | 5/2006 | Li | |
| 7,124,694 | B2 | 10/2006 | Li | |
| D553,868 | S * | 10/2007 | Knapper | D6/337 |
| 2003/0084626 | A1 * | 5/2003 | Hsieh et al. | 52/220.1 |
| 2004/0221883 | A1 * | 11/2004 | Nipke | 135/16 |

* cited by examiner

*Primary Examiner*—David Dunn
*Assistant Examiner*—Tania Abraham
(74) *Attorney, Agent, or Firm*—Montgomery Patent and Design; Robert C. Montgomery; Joseph T. Yaksich

(57) ABSTRACT

A wooden octagonal picnic table and bench system with integral wooden umbrella and accessory platforms is herein disclosed. The table comprises eight (8) equal sides with four (4) separated seat benches with a centrally oriented umbrella-shaped roof assembly. The benches are attached at their base using a plurality of supports for stability. A cup holder platform is located at the tabletop surface and encircles the center vertical post. At an intermediate location up the post is a tray with a containment lip to hold bottles, condiments or other similar containers around the post. A wine glass holder is provided near the top of the post facing in all directions for holding stemware in an inverted position. The table also provides roof-mounted lighting and electricity thereto appliances and accessories via a pair of duplex outlets mounted thereto an upper portion of the center post.

17 Claims, 6 Drawing Sheets

OCTAGONAL PATIO PICNIC TABLE WITH ACCESSORIES

RELATED APPLICATIONS

The present invention was first described in and claims the benefit of U.S. Provisional Patent No. 60/905,060 filed Mar. 6, 2007, the entire disclosures of which are incorporated herein by reference.

FIELD OF THE INVENTION

The present invention describes a patio picnic table having an eight-sided configuration and further comprising commonly associated accessories including means for supporting a plurality of lighting elements.

BACKGROUND OF THE INVENTION

Emerging as a new segment in lawn and garden retailing is outdoor living—an evolution of the market for patio furniture and grills that piggybacked on home decor trends. The idea of creating an outside room for retreat or entertaining keeps getting stronger, resulting in a robust market for a widening assortment of outdoor living products. Trends in outdoor living have taken an interesting turn in that just about anything goes now.

Picnic tables can be found in backyards, parks, campgrounds and rest stops across the country. Such tables vary widely in design and size, but all serve to facilitate the function of the eating outside. While they perform this function admirably well, several disadvantages still remain. First, separate picnic benches are prone to tipping over due to uneven loading, uneven ground and the like. Secondly, direct sun is always a problem. While some picnic tables are provided with an integral umbrella, they are typically small in size and provide shade for only one or two people. Third, wind or even mild breezes, tend to knock over cups, bottles, condiments and the like. Finally, picnic table manufacturers are on the constant lookout for features and enhancements to make their tables more attractive and functional.

Accordingly, there is a need for a means by which the functionality of a picnic table can be enhanced to address the shortcomings described above, allowing users to engage in outdoor entertaining without sacrificing amenities, convenience and accessibility. The development of the invention herein described fulfills this need.

U.S. Pat. No. 7,124,694 filed by Li discloses an umbrella table with inlaid turntable. This patent does not appear to disclose an octagonal patio picnic table with an integral umbrella roof structure, cup holders, storage rack or electrical system.

U.S. Pat. No. 7,044,064 filed by Li discloses an umbrella table with inlaid turntable. This patent does not appear to disclose an octagonal patio picnic table with an integral umbrella roof structure, cup holders, storage rack or electrical system.

U.S. Pat. No. D 411,927 filed by Van Rhienen discloses an octagon table with four legs. This design patent does not appear to disclose an octagonal patio picnic table with an integral umbrella roof structure, cup holders, storage rack or electrical system nor is the design similar to that of the instant invention described herein.

U.S. Pat. No. 5,803,265 filed by Bergerman discloses a patio table tray. This patent does not appear to disclose an octagonal picnic table with the accessories possessed by the instant invention herein described.

U.S. Pat. No. D 378,479 filed by Smith discloses a table. This design patent does not appear to disclose an octagonal patio picnic table with an integral umbrella roof structure, cup holders, storage rack or electrical system nor is the design similar to that of the instant invention described herein.

U.S. Pat. No. 5,493,976 filed by Hammond discloses a table tray adapted for installation around an umbrella pole. This patent does not appear to disclose an octagonal picnic table with the accessories possessed by the instant invention herein described.

U.S. Pat. No. 5,335,803 filed by O'Brien and O'Brien discloses a rotatable food tray for outdoor patio furniture. This patent does not appear to disclose an octagonal picnic table with the accessories possessed by the instant invention herein described.

U.S. Pat. No. 5,027,718 filed by Graham discloses a sectional table. This patent does not appear to disclose an octagonal patio picnic table with an integral umbrella roof structure, cup holders, storage rack or electrical system.

U.S. Pat. No. 4,635,614 filed by Segroves discloses a deep fat frying pot cooker holding and picnic table. This patent does not appear to disclose an octagonal patio picnic table with an integral umbrella roof structure, cup holders, storage rack or electrical system.

U.S. Pat. No. D 258,029 filed by Redmond discloses an octagonal game table. This design patent does not appear to disclose an octagonal patio picnic table with an integral umbrella roof structure, cup holders, storage rack or electrical system nor is the design similar to that of the instant invention described herein.

U.S. Pat. No. D 250,684 filed by Van Sant discloses a table. This design patent does not appear to disclose an octagonal patio picnic table with an integral umbrella roof structure, cup holders, storage rack or electrical system nor is the design similar to that of the instant invention described herein.

U.S. Pat. No. D 241,999 filed by Carter discloses a table. This design patent does not appear to disclose an octagonal patio picnic table with an integral umbrella roof structure, cup holders, storage rack or electrical system nor is the design similar to that of the instant invention described herein.

U.S. Pat. No. D 239,843 filed by Freeman discloses a convertible game and dining table. This design patent does not appear to disclose an octagonal patio picnic table with an integral umbrella roof structure, cup holders, storage rack or electrical system nor is the design similar to that of the instant invention described herein.

U.S. Pat. No. D 237,563 filed by Gerber discloses a convertible game table. This design patent does not appear to disclose an octagonal patio picnic table with an integral umbrella roof structure, cup holders, storage rack or electrical system nor is the design similar to that of the instant invention described herein.

U.S. Pat. No. D 233,497 filed by Zelkowitz discloses a convertible game table. This design patent does not appear to disclose an octagonal patio picnic table with an integral umbrella roof structure, cup holders, storage rack or electrical system nor is the design similar to that of the instant invention described herein.

The prior art appears to disclose tables that serve various functions. The prior art does not appear to disclose a octagonal patio picnic table that possesses integral seating, an umbrella roof structure, cup holders, a storage shelf and an electrical supply system.

SUMMARY OF THE INVENTION

In view of the foregoing disadvantages inherent in the prior art, it has been observed that there is need for a patio picnic table that possesses integral seating, cup holders, storage rack and an electrical supply.

The octagonal patio picnic table provides users with a firm and stable wooden picnic table area with enhancements in a manner, which is convenient, beneficial, and attractive.

The octagonal patio picnic table with accessories comprises a large eight-sided picnic table with several enhancements including large attached bench seats to accommodate approximately eight (8) people, wheelchair access, a large umbrella shaped wooden roof, overhead lighting, a convenient cup holder for approximately eight (8) cups, a storage shelf, and a wine glass hanger.

The octagonal patio picnic table provides a wooden assembly comprising a base, a pair of first seats, a pair of second seats, a plurality of supports, a tabletop, a center post, and an umbrella roof. Said wooden assembly is envisioned to be constructed using a plurality of two (2) inch thick pressure treated lumber boards attached using corrosion-resistant fastening means such as, but not limited to: nail tooth plates, screws, lag bolts, and nails.

The octagonal patio picnic table with accessories is constructed of construction materials such as, but not limited to: one (1) inch thick boards, composite lumber, extruded aluminum, or fiberglass panels. The apparatus is further envisioned to be provided in a variety of finishes and colors such as but not limited to, natural color, stained, various painted colors, and the like.

The octagonal patio picnic table with accessories possesses a base comprising an eight (8) sided polygon made up of boards. The base preferably comprises an overall size of approximately seven (7) to ten (10) feet across; however, it is understood that the apparatus may be scaled appropriately so as to provide a children's model, thereby providing a similar benefit to children. The base provides an attachment means for a plurality of support boards comprising an interconnected sub-structure providing stability and a secure attachment means for the first and second seats, the tabletop and the post, by providing multiple connection points thereupon.

The octagonal patio picnic table with accessories possesses seating surfaces having two (2) different depths for differently sized occupants. The first seats are located at opposing sides of the apparatus and comprise a wide seating surface approximately fifteen (15) inches deep comprising an assembly of parallel boards providing a large enough seating area to comfortably accommodate two (2) large adults. The second seats also located at opposing sides of the apparatus 10 comprise a more narrow seating surface of approximately twelve (12) inches deep being wide enough to accommodate two (2) smaller adults or children, for example. The four (4) seats are arranged and attached to the base in such a position as to provide an access space between any two (2) adjacent seats thereby enabling a convenient approach thereto said seats without having to step over said seating. The space between the seats provides easy access thereto elderly, encumbered, or wheelchair occupants.

The octagonal patio picnic table with accessories provides additional storage means due to the open construction of the seats and associated support boards allowing a variety of items to be conveniently stored under or adjacent thereto said seats within the perimeter of the base portion of the apparatus 10 such as, but not limited to: coolers, purses, audio devices, extra food/drink storage, and the like.

The tabletop comprises an octagonal shaped assembly of parallel or circumscribed boards affixed thereto said support boards using conventional carpentry techniques, thereby providing a flat horizontal surface approximately four (4) to six (6) feet across.

The center post comprises a sturdy vertical column preferably using a four-by-four (4×4) inch post, a six-by-six (6×6) inch post, or an assembly of boards extending approximately six (6) to ten (10) feet above ground level. The post provides a supporting structure and attachment means for the cup holder, the glass hanger, the storage shelf, and the umbrella roof. The post extends down through the tabletop and is secured to the support boards using common fasteners.

The octagonal patio picnic table with accessories center post also provides electrical power thereto the umbrella roof via a male plug, internal wiring, and a pair of mounted duplex outlets. The male plug comprises a common three (3) prong plug being mounted permanently thereto a lower-central portion of the supports using common fasteners and being in electrical communication therewith common wiring affixed to the center post and being routed internally or externally to said post. Said wiring extends in an upward direction thereto a pair of duplex outlets. The male plug provides a removably attachable electrical connection thereto a common extension cord, thereby providing a convenient 110-volt power supply means thereto the apparatus.

The octagonal patio picnic table with accessories umbrella roof provides protection thereto occupants therefrom sun and rain via an all-wood construction mounted securely and permanently thereto an upper portion of the post extending outwardly over the seats forming an octagonal perimeter shape. The umbrella roof comprises a plurality of supporting roof members affixed thereto said center post and extending in an angular arrangement outwardly thereto the umbrella roof. The umbrella roof provides a rugged construction capable of withstanding anticipated wind forces of inclement weather. The umbrella roof comprises similar outside dimensions as the base being approximately seven (7) to ten (10) feet across.

The umbrella roof is constructed of construction materials similar to those used in the base such as, but not limited to, wood, a tube frame with canvas or vinyl covering, sheet metal panels, or fiberglass panels. The center post and umbrella roof comprise sufficient structural strength so as to withstand wind and rain forces associated with normal outdoor use.

The octagonal patio picnic table possesses enhanced features comprising a cup holder, a storage shelf, and a glass hanger.

The cup holder is attached to the post using common fasteners and circumscribes said post around at a vertical position approximately three (3) inches above and parallel thereto the tabletop surface. The cup holder is envisioned to provide openings for approximately eight (8) cups 100 of a standard diameter. The cup holder is further envisioned to be octagonal in shape and having a thickness of approximately one-half (½) inch. The cup holder is preferably made using wood; however, other common materials may be provided such as metal, fiberglass, or the like.

The storage shelf comprises an eight (8) sided horizontal shelf with enclosed side portions approximately six (6) inches high to safely contain a plurality of bottles, glasses, and the like. The storage shelf is attached to and circumscribes said post around at an approximate vertical position of fourteen (14) to twenty (20) inches above, and parallel thereto, the tabletop surface. The storage shelf is preferably made using wood; however, other common materials may be provided such as metal, fiberglass, or the like.

The glass hanger provides a storage means for wine glasses or other glasses which comprise a thin stem. The glass hanger comprises approximately eight (8) cut-out slots suitable to support glasses hanging in an inverted orientation to keep said glasses clean. The glass hanger comprises similar materials and construction to that of the cup holder and is to be attached thereto the post in a like manner approximately two (2) feet above the storage shelf.

The octagonal patio picnic table with accessories possesses an umbrella roof portion comprising a plurality of roof members, wiring, a pair of duplex outlets, and attached lighting.

The umbrella roof portion wiring comprises common insulated copper conductors with ground, originating from a male plug located at a base portion of the post. The wiring extends in an upward direction within the post to a pair of duplex outlets.

The duplex outlets are connected to the post using conventional electrical installation methods and fasteners being positioned thereupon opposing outer surfaces of the post above the glass hanger. The duplex outlets comprise common outdoor-type self-contained electrical box units envisioned to include weather-proof seals and features suitable thereto outdoor applications. The duplex outlets provide a 110-volt power supply to various electrical devices and appliances which may be used such as, but not limited to, blenders, toasters and stereos.

The duplex outlets further provide electrical power thereto one (1) or more strands of rope lighting or other forms of lighting. The lighting may be permanently or temporarily mounted thereto a lower surface of the umbrella roof and roof members using common fasteners such as, but not limited to, clips, staples, eyelets, or tie-straps arranged in a linear or circular pattern in order to provide desired lighting effects.

The octagonal patio picnic table with accessories may be used by performing the following steps: moving and locating the apparatus to a desired location thereupon a patio, deck, or flat ground surface; installing lighting therewith a plurality of fasteners in a desired pattern along a bottom surface of the umbrella roof to produce a desired lighting effect, if not previously installed; routing a conventional electrical cord from an existing electrical source thereto the male plug, thereby energizing both the lighting and the duplex outlets; adding various cups, bottles, glasses, and other eating and drinking accessories thereinto the cup holder, the storage shelf, and the glass hanger based upon a user's preferences; plugging various appliances and devices thereinto the duplex outlets as desired; occupying the seats by utilizing the convenient openings therebetween said seats enabling even elderly or encumbered participants easy access; and, sitting and enjoying the protection and convenience afforded a user of the invention when picnicking with family and friends.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
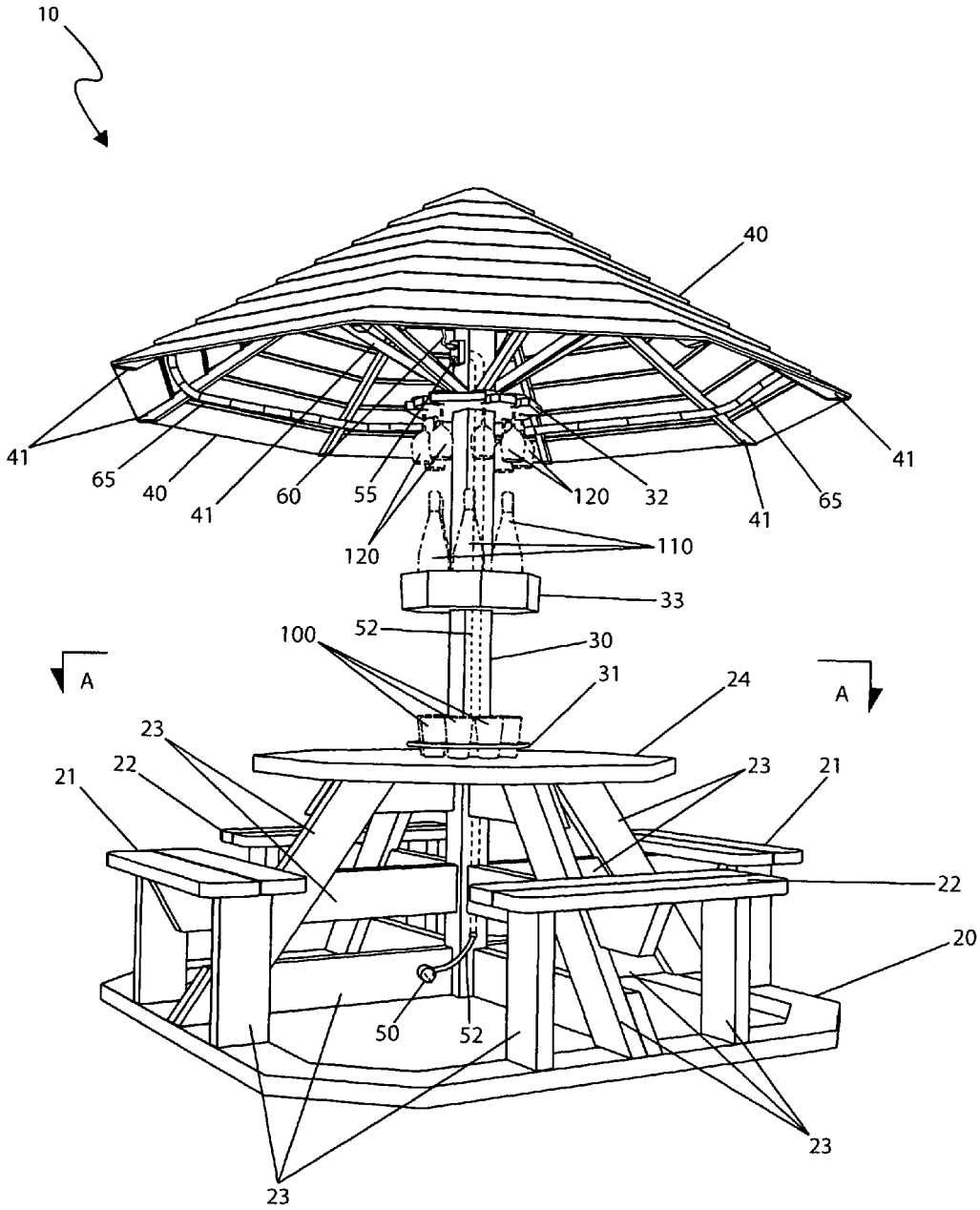
FIG. 1 is a front perspective view of an octagonal patio picnic table with accessories 10, according to a preferred embodiment of the present invention.

10 octagonal patio picnic table with accessories
20 base
21 first seat
22 second seat
23 supports
24 tabletop
28 wiring slot
29 decorative trim
30 post
31 cup holder
32 glass hanger
33 storage shelf
40 umbrella roof
41 roof member
50 male plug
52 wiring
55 duplex outlet
60 power cord
62 fastener
65 lighting
100 cup
110 bottle
120 glass

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and that example configurations shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method for an octagonal patio picnic table with accessories (herein described as the "apparatus") 10, comprising a large eight-sided picnic table with several enhancements including large attached bench seats 21 to accommodate approximately eight (8) people, wheelchair access, a large umbrella shaped wooden roof 40, overhead lighting 65, a convenient cup holder 31 for approximately eight (8) cups, a storage shelf 33, and a wine glass hanger 32. The apparatus 10 provides users with a firm and stable wooden picnic table area with enhancements in a manner, which is convenient, beneficial, and attractive.

Referring now to FIGS. 1 through 6, various views of the apparatus 10, according to the preferred embodiment of the present invention, are disclosed. The apparatus 10 provides a wooden assembly comprising a base 20, a pair of first seats 21, a pair of second seats 22, a plurality of supports 23, a tabletop 24, a center post 30, and an umbrella roof 40. Said wooden assembly is envisioned to be constructed using a plurality of two (2) inch thick pressure treated lumber boards attached using corrosion-resistant fastening means such as nail tooth plates, screws, lag bolts, nails, or the like; however, other construction materials may be provided such as one (1) inch thick boards, composite lumber, extruded aluminum, fiberglass panels, or the like, and as such, should not be interpreted as a limiting factor of the present invention. The apparatus 10 is further envisioned to be provided in a variety of finishes and colors such as but not limited to, natural color, stained, various painted colors, and the like. The base 20 comprises an eight (8) sided polygon made up of the aforementioned boards. The base 20 preferably comprises an overall size of approximately seven (7) to ten (10) feet across; however, it is understood that the apparatus 10 may be scaled appropriately so as to provide a children's model, thereby providing a similar benefit to children. The base 20 provides an attachment means for a plurality of support boards 23 comprising an interconnected sub-structure providing stability and a secure attachment means for the first 21 and second 22 seats, the tabletop 24, and the post 30, by providing multiple connection points thereupon. The apparatus 10 provides seating surfaces having two (2) different depths for differently sized occupants (see FIG. 5). The first seats 21 are located at opposing sides of the apparatus 10 and comprise a wide seating surface approximately fifteen (15) inches deep comprising an assembly of parallel boards providing a large enough seating area to comfortably accommodate two (2) large adults, for example. The second seats 22 also located at opposing sides of the apparatus 10 comprise a more narrow seating surface of approximately twelve (12) inches deep being wide enough to accommodate two (2) smaller adults or children, for example. The four (4) seats 21, 22 are arranged and attached to the base 20 in such a position as to provide an access space between any two (2) adjacent seats 21, 22 thereby enabling a convenient approach thereto said seats 21, 22 without having to step over said seating 21, 22 in a manner associated with many conventional picnic table models. The space between the seats 21, 22 provides easy access thereto elderly, encumbered, or wheelchair occupants. The apparatus 10 provides additional storage means due to the open construction of the seats 21, 22 and associated support boards 23 allowing a variety of items to be conveniently stored under or adjacent thereto said seats 21, 22 within the perimeter of the base portion 20 of the apparatus 10 such as, but not limited to: coolers, purses, audio devices, extra food/drink storage, and the like. The tabletop 24 comprises an octagonal shaped assembly of parallel or circumscribed boards affixed thereto said support boards 23 using conventional carpentry techniques, thereby providing a flat horizontal surface approximately four (4) to six (6) feet across. The center post 30 comprises a sturdy vertical column preferably using a four-by-four (4×4) inch post, a six-by-six (6×6) inch post, or an assembly of boards extending approximately six (6) to ten (10) feet above ground level. The post 30 provides a supporting structure and attachment means for the cup holder 31, the glass hanger 32, the storage shelf 33, and the umbrella roof 40. The post 30 extends down through the tabletop 24 and is secured to the support boards 23 using common fasteners. The center post 30 also provides electrical power thereto the umbrella roof 40 via a male plug 50, internal wiring 52, a wiring slot 28, a length of decorative trim 29, and a pair of mounted duplex outlets 55. The male plug 50 comprises a common three (3) prong plug being mounted permanently thereto a lower-central portion of the supports 23 using common fasteners and being in electrical communication therewith common wiring envisioned being Romex or similar common conductors being routed along the post 30 therewithin a vertically sawn wiring slot 28 and discreetly covered using decorative trim 29 (see FIG. 6). Said wiring 52 extends in an upward direction thereto a pair of duplex outlets 55 (see FIG. 2). The male plug 50 provides a removably attachable electrical connection thereto a common extension cord, thereby providing a convenient 110-volt power supply means thereto the apparatus 10. The umbrella roof 40 provides protection thereto occupants therefrom sun and rain via an all-wood construction mounted securely and permanently thereto an upper portion of the post 30 extending outwardly over the seats 21, 22 forming an octagonal perimeter shape. The umbrella roof 40 comprises a plurality of supporting roof members 41 affixed thereto said center post 30 and extending in an angular arrangement outwardly thereto the umbrella roof 40. The umbrella roof 40 provides a rugged construction capable of withstanding anticipated wind forces of inclement weather. The umbrella roof 40 comprises similar outside dimensions as the base 20 being approximately seven (7) to ten (10) feet across being illustrated in FIG. 1 in the preferred wooden embodiment; however, the umbrella roof 40 may be built using alternate construction materials such as, but not limited to: a tube frame with canvas or vinyl covering, sheet metal panels, fiberglass panels, or the like, and as such should not be interpreted as a limiting factor of the present invention 10. The center post 30 and umbrella roof 40 comprise sufficient structural strength so as to withstand wind and rain forces associated therewith normal outdoor use.

The apparatus 10 further provides enhanced features comprising a cup holder 31, a storage shelf 33, and a glass hanger 32. The cup holder 31 is attached thereto the post 30 using common fasteners and circumscribes said post 30 therearound at a vertical position approximately three (3) inches above and parallel thereto the tabletop surface 24. The cup holder 31 is envisioned to provide openings for approximately eight (8) cups 100 of a standard diameter. The cup holder 31 is further envisioned to be octagonal in shape and having a thickness of approximately one-half (½) inch. The cup holder 31 is preferably made using wood; however, other common materials may be provided such as metal, fiberglass, or the like. The storage shelf 33 comprises an eight (8) sided horizontal shelf with enclosed side portions approximately six (6) inches high to safely contain a plurality of bottles 110, glasses 120, and the like. The storage shelf 33 is attached to and circumscribes said post 30 therearound at an approximate vertical position of fourteen (14) to twenty (20) inches above, and parallel thereto, the tabletop surface 24. The storage shelf 33 is preferably made using wood; however, other common materials may be provided such as metal, fiberglass, or the like. The glass hanger 32 provides a storage means for wine glasses 120 or other glasses which comprise a thin stem. The glass hanger 32 comprises approximately eight (8) cut-out slots suitable to support glasses 120 hanging in an inverted orientation to keep said glasses 100 clean. The glass hanger 32 comprises similar materials and construction to that of the cup holder 31 and is to be attached thereto the post 30 in like manner approximately two (2) feet above the storage shelf 33.

Figure 2:
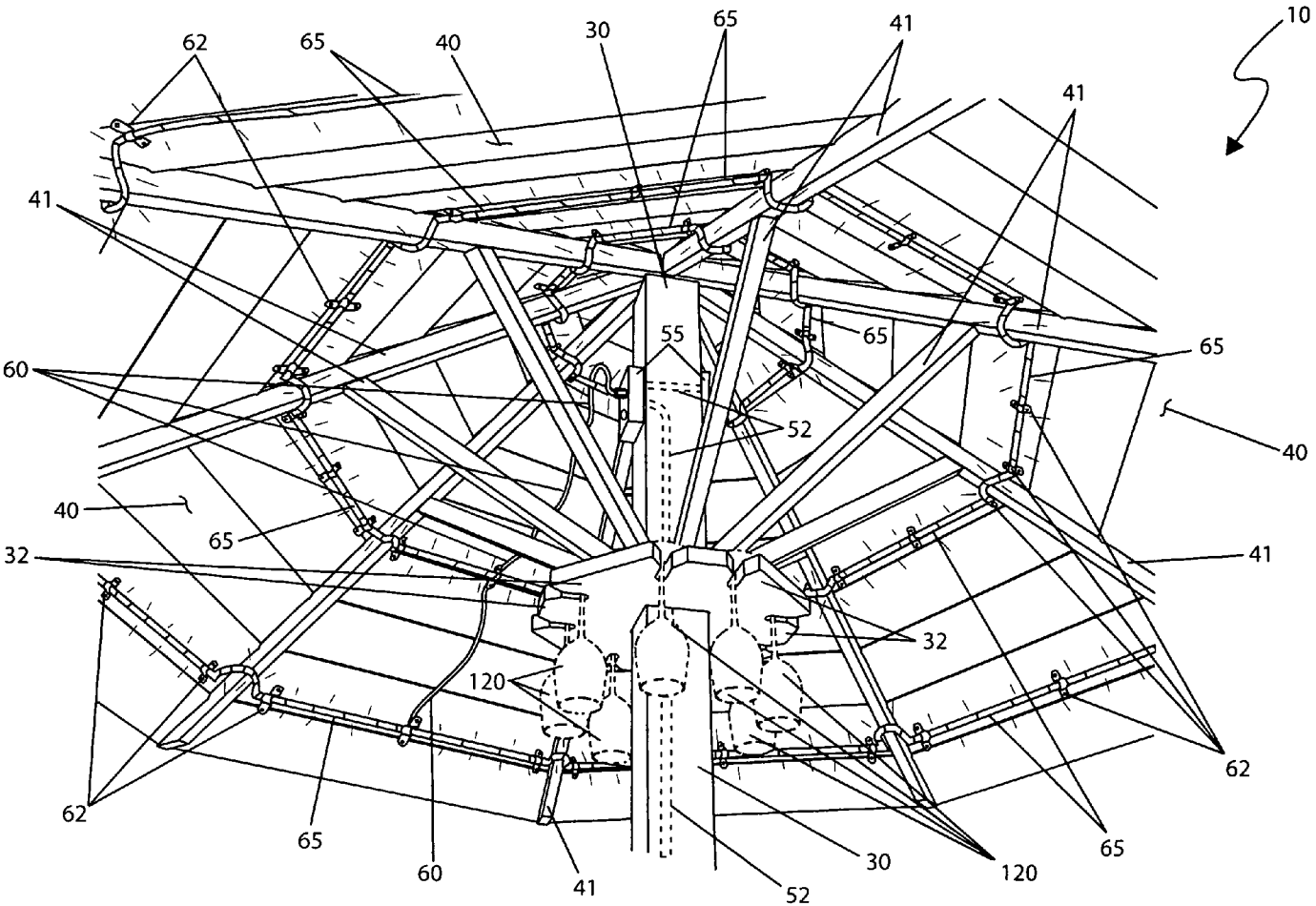
FIG. 2 is an upward looking view of an octagonal patio picnic table with accessories 10 depicting an umbrella roof portion 40, according to a preferred embodiment of the present invention.
Figure 3:
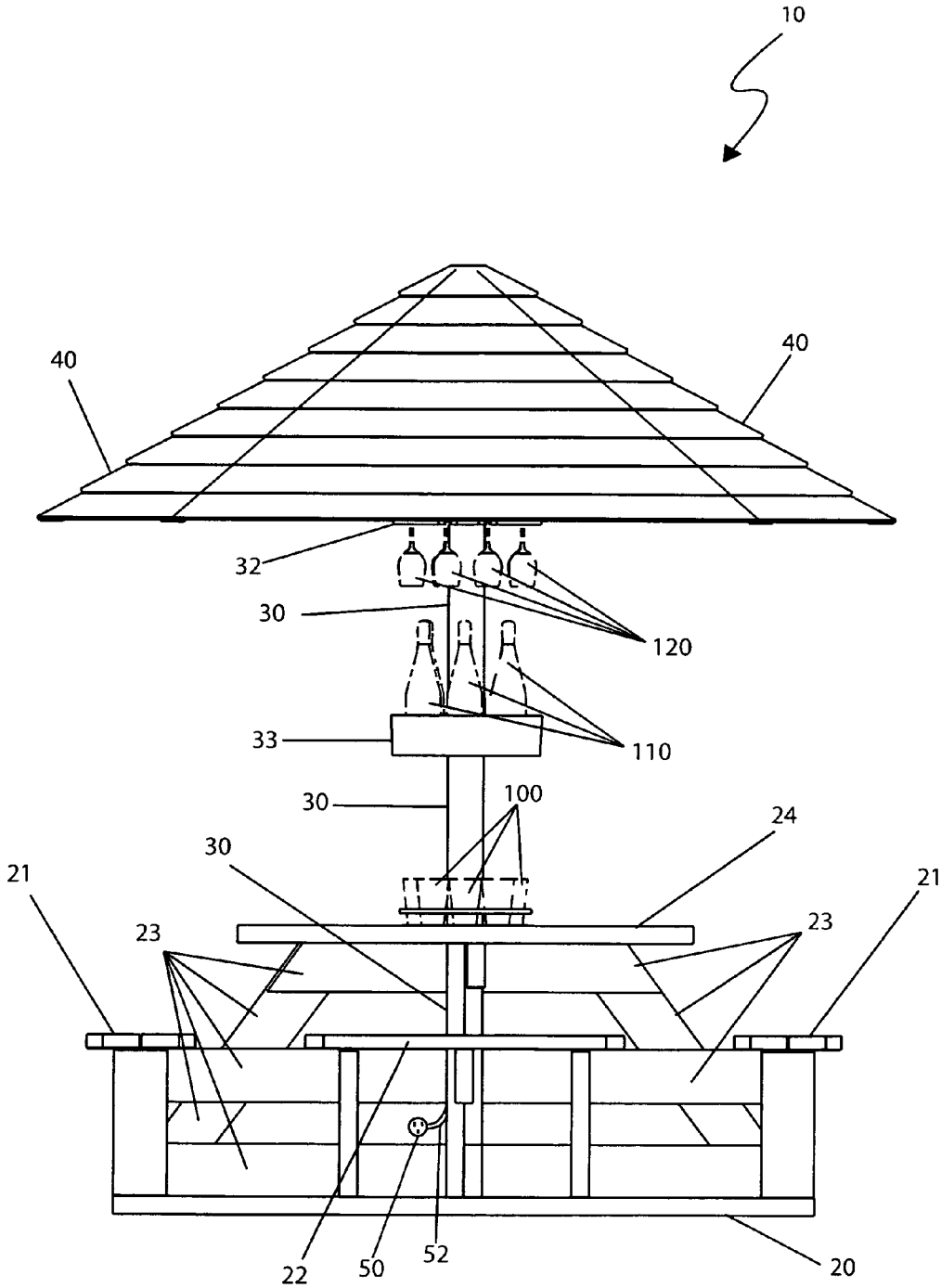
FIG. 3 is a side isometric view of an octagonal patio picnic table with accessories 10, according to a preferred embodiment of the present invention; and, FIG. 4 is a top view of an octagonal patio picnic table with accessories 10, according to a preferred embodiment of the present invention.
Figure 4:
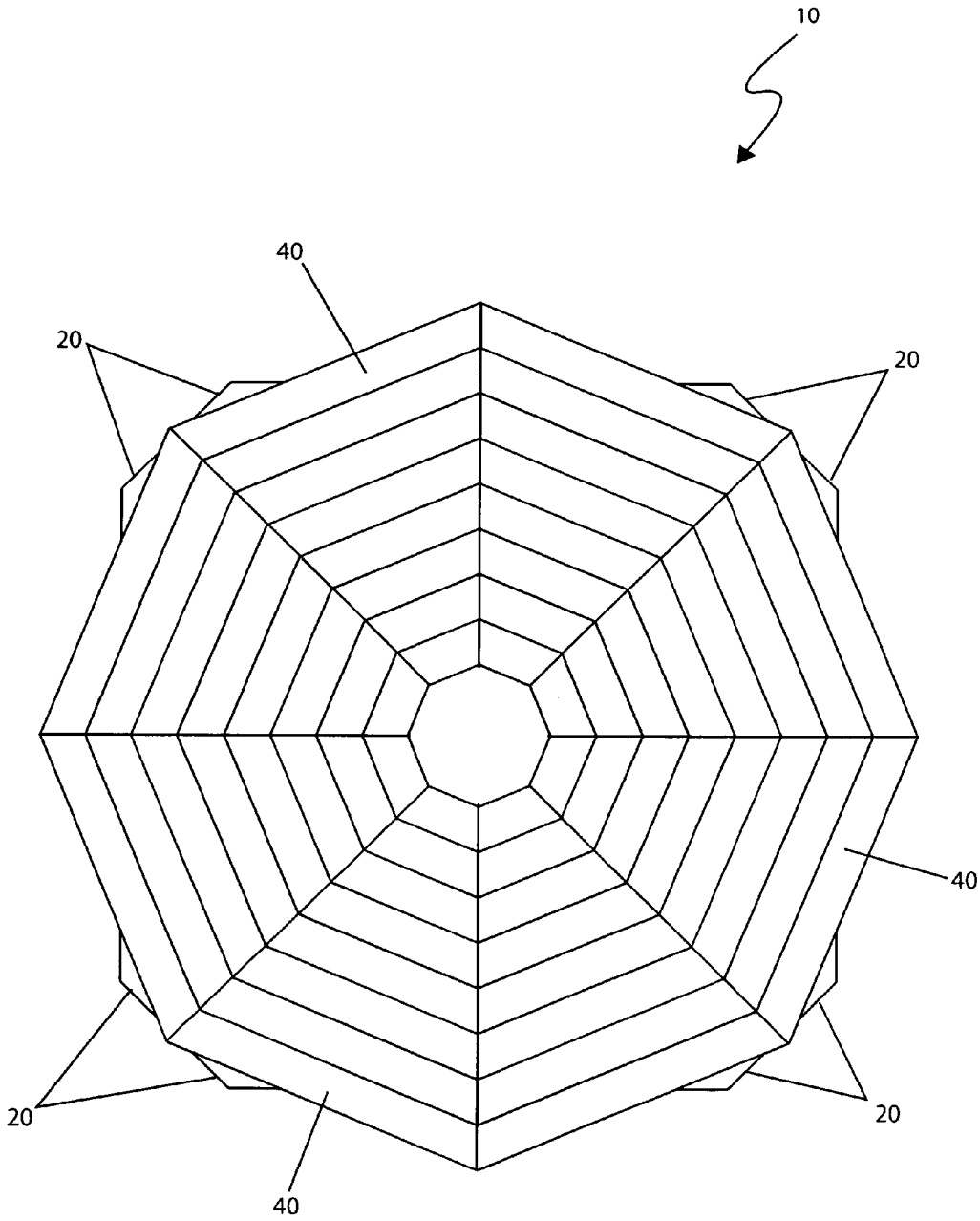
Figure 5:
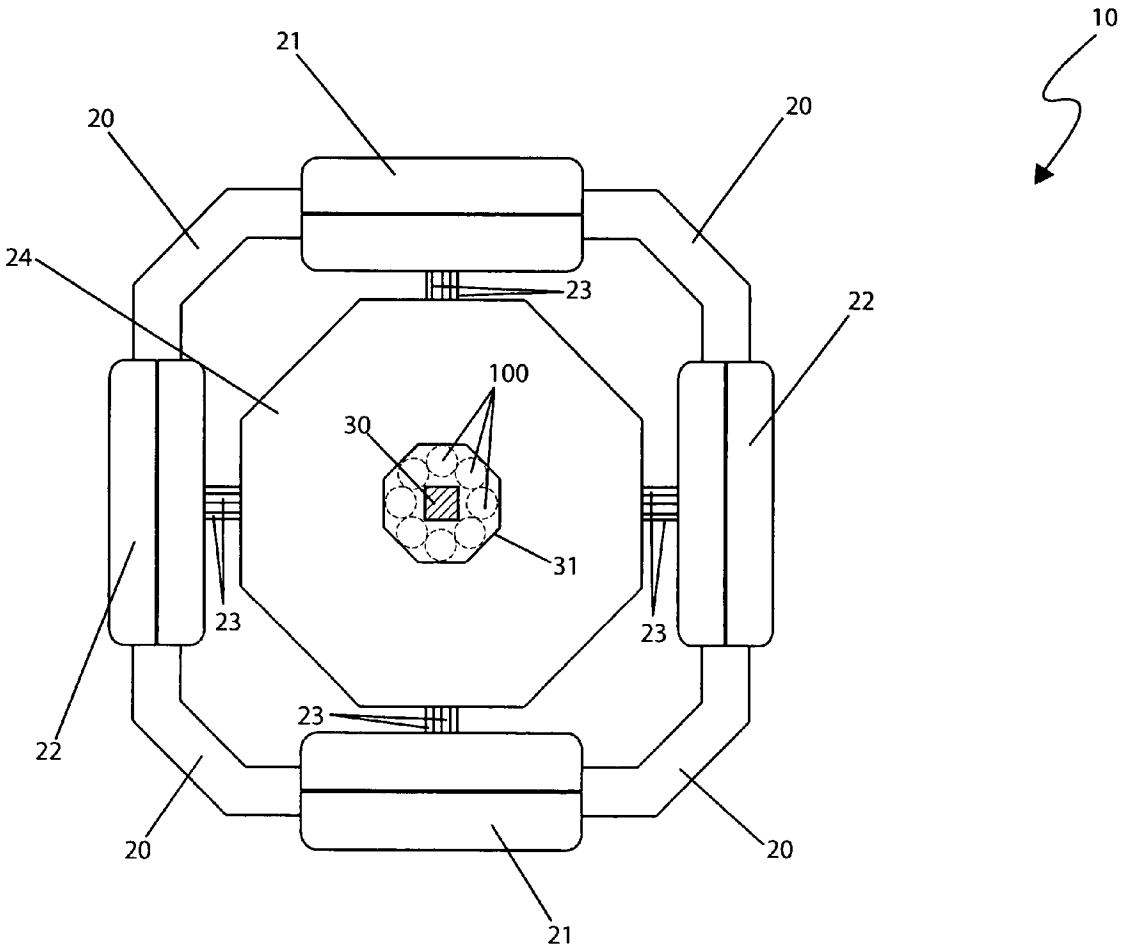
FIG. 5 is a top section view taken along section A-A of FIG. 1 of an octagonal patio picnic table with accessories 10, according to a preferred embodiment of the present invention; and, FIG. 6 is a close-up view of the apparatus 10 depicting routing of the wiring 52 therein a bottom portion of a post 30, according to a preferred embodiment of the present invention.
Figure 6:
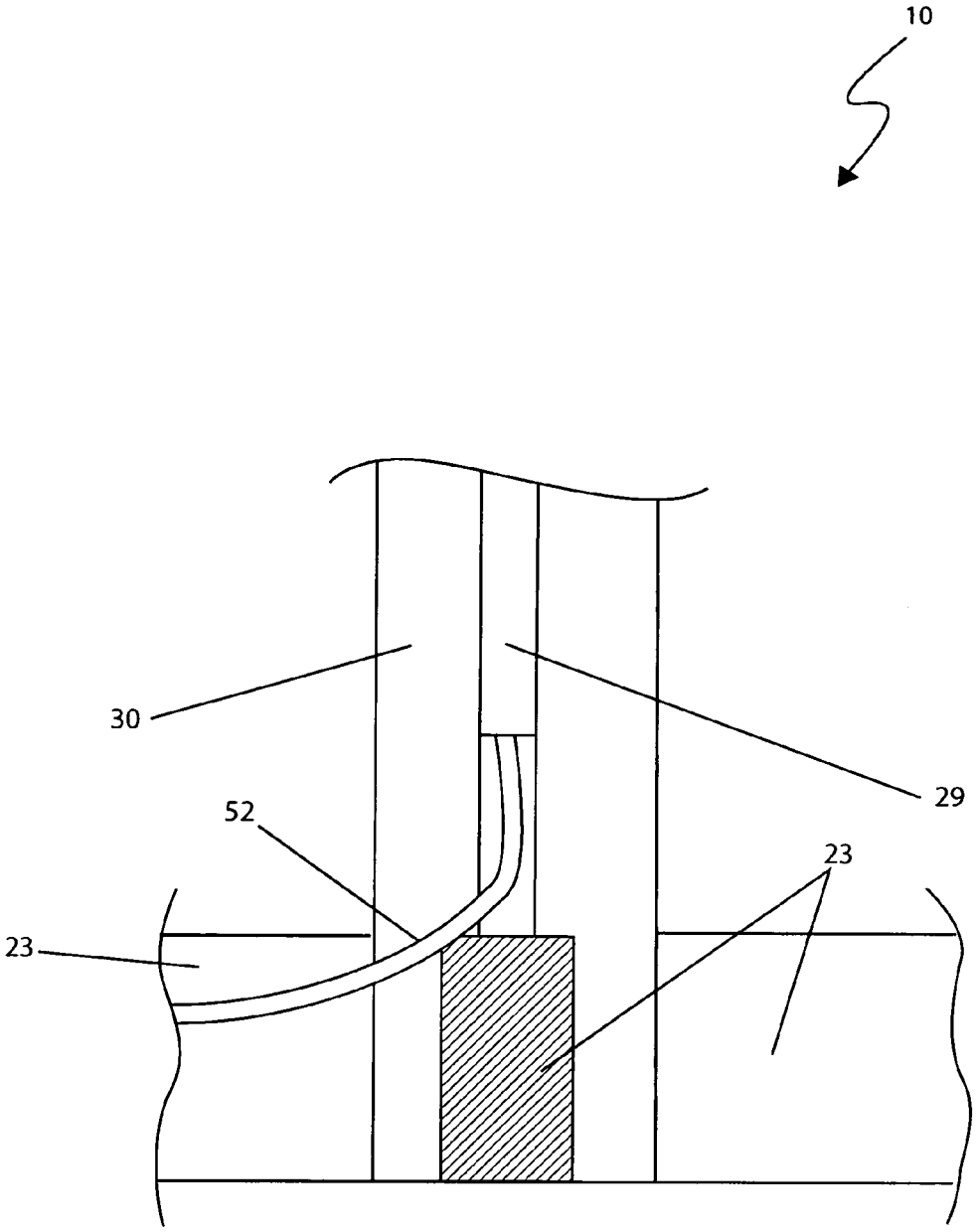

Referring now to FIG. 2 is an upward looking view of the apparatus 10 depicting an umbrella roof portion 40, according to a preferred embodiment of the present invention. The umbrella roof portion 40 further comprises a plurality of roof members 41, wiring 52, a pair of duplex outlets 55, and attached lighting 65. The wiring 52 comprises common insulated copper conductors with ground, originating therefrom a male plug 50 located at a base portion of the post 30 (see FIG. 1). Said wiring 52 extends in an upward direction therewithin the post 30 thereto a pair of duplex outlets 55. The post 30 provides an attachment means thereto the duplex outlets 55 using conventional electrical installation methods and fasteners being positioned thereupon opposing outer surfaces of the post 30 above the glass hanger 32. The duplex outlets 55 comprise common outdoor-type self-contained electrical box units envisioned to include weather-proof seals and features suitable thereto outdoor applications. The duplex outlets 55 provide a 110-volt power supply thereto various electrical devices and appliances which may be used in conjunction therewith the apparatus 10 such as blenders, toasters, stereos, and the like. The duplex outlets 55 further provide electrical power thereto one (1) or more strands of rope lighting 65 as illustrated here; however, it is understood that various types of lighting fixtures arranged in any number of patterns and colors may be provided without deviating from the concept and as such should not be interpreted as a limiting factor of the invention 10. Said lighting 65 may be permanently or temporarily mounted thereto a lower surface of the umbrella roof 40 and roof members 41 using common fasteners 62 such as clips, staples, eyelets, tie-straps, or the like, being arranged in a linear or circular pattern to provide a variety of desired lighting effects.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed and utilized as indicated in FIGS. 1 through 4.

The method of installing and utilizing the apparatus 10 may be achieved by performing the following steps: moving and locating the apparatus 10 thereto a desired location thereupon a patio, deck, or flat ground surface; installing lighting 65 therewith a plurality of fasteners 62 in a desired pattern along a bottom surface of the umbrella roof 40 to produce a desired lighting effect, if not previously installed; routing a conventional electrical cord from an existing electrical source thereto the male plug 50, thereby energizing both the lighting 65 and the duplex outlets 55; adding various cups 100, bottles 110, glasses 120, and other eating and drinking accessories thereinto the cup holder 31, the storage shelf 33, and the glass hanger 32 based upon a user's preferences; plugging various appliances and devices thereinto the duplex outlets 55 as desired; occupying the seats 21, 22 by utilizing the convenient openings therebetween said seats 21, 22 enabling even elderly or encumbered participants easy access; and, sitting and enjoying the protection and convenience afforded a user of the invention 10 when picnicking with family and friends.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A table providing a firm and stable seating means and further comprising:

a base, comprising an eight-sided configuration utilizing construction boards and providing an attachment means for a plurality of support means, wherein said plurality of support means comprises an interconnected substructure providing stability and a secure attachment means for a pair of first seating assemblies, a pair of second seating assemblies, a center post, and a tabletop by providing multiple connection points thereupon;

said pair of first seating assemblies attached to said base at opposing sides of said table;

said pair of second seating assemblies attached to said base at opposing sides of said table;

said center post attached to said base at a lower end and having an upper end, further comprising:

a sturdy vertical column extending down through said tabletop and secured to said plurality of supports at said lower end and a roof assembly at said upper end;

a groove extending a length of a single side of said center post to accommodate an electrical cord;

a trim piece for decoratively concealing said electrical cord and fitting therein said groove;

a lower male plug mounted at a lower end of said groove at said lower end of said center post;

a pair of mounted duplex outlets mounted at opposing sides of said upper end of said center post above an upper end of said groove; and, said electrical cord routed upwardly from said male plug thereto said pair of mounted duplex outlets through said groove;

said tabletop attached to said base; and, said roof assembly attached to said upper end of said center post;

wherein said base rests on a ground surface;

wherein said pair of first seating assemblies and said pair of second seating assemblies each further comprise a horizontal seat assembly of parallel boards attached to said base via a pair of vertical supports at opposing ends of said seat assembly;

wherein said pair of first seating assemblies and said pair of second seating assemblies each are arranged and attached to said base in such a position as to provide an access space thereby enabling a convenient approach;

wherein said access space provides easy access to elderly, encumbered, or wheelchair occupants;

wherein additional storage means is provided, thereby allowing a variety of items to be conveniently stored under or adjacent to said pair of first seating assemblies and said second seating assemblies within a perimeter of said base; and, wherein said pair of first seating assemblies, said second pair of seating assemblies, said center post, and said tabletop are attached to said base with said plurality of support means.

2. The table of claim 1, wherein said base further comprises a total width in the range of and including seven (7) to ten (10) feet.

3. The table of claim 1, wherein said pair of first seating assemblies comprises dimensions of approximately fifteen (15) inches deep and said pair of second seating assemblies approximately twelve (12) inches deep.

4. The table of claim 1, wherein said center post further comprises a four-by-four (4×4) inch post, a six-by-six (6×6) inch post, or an assembly of boards and extends to a height in the range of and including six (6) to ten (10) feet above said ground surface.

5. The table of claim 1, wherein said tabletop comprises an eight-sided assembly of parallel or circumscribed boards attached thereto said plurality of supports thereby providing a flat horizontal surface.

6. The table of claim 5, wherein said tabletop comprises dimensions in the range of and including four (4) to six (6) feet in width.

7. The table of claim 5, wherein said roof assembly further comprises:

a rugged construction mounted securely and permanently to said upper end of said center post and further comprises:

a roof extending outwardly and downwardly over said table and forming an eight-sided perimeter shape; and, a plurality of supporting roof members attached to said center post and extending in an angular arrangement outwardly to said roof;

wherein said roof provides protection to occupants and said table from inclement weather.

8. The table of claim 7, wherein said roof assembly comprises a total width in the range of and including seven (7) to ten (10) feet.

9. The table of claim 7, further comprising a set of accessories, further comprising:

decorative lighting mounted to said roof assembly at equidistant locations on said plurality of supporting roof members;

a cup holder attached to and circumscribing said center post at a minimal distance above said tabletop;

a storage shelf attached to and circumscribing said center post at an intermediate distance above said tabletop; and, a glass hanger attached to and circumscribing said center post at a maximal distance above said tabletop.

10. The table of claim 9, wherein said cup holder further comprises:

an eight-sided configuration having a thickness of approximately one-half (½) inch;

a plurality of openings for up to eight (8) cups of a standard diameter; and, attached to said center post at said minimal distance approximately three (3) inches above and parallel to said tabletop.

11. The table of claim 9, wherein said storage shelf further comprises:

an eight-sided horizontal shelf with enclosed side portions approximately six (6) inches high to safely contain a plurality of items; and, attached to said center post at said intermediate distance in the range of and including fourteen (14) to twenty (20) inches above and parallel to said tabletop.

12. The table of claim 9, wherein said glass hanger further comprises:

an eight-sided configuration with a plurality of cut-out slots for up to eight (8) pieces of stemware suitable to support said stemware hanging in an inverted orientation; and, attached to said center post at said maximal distance approximately two (2) feet above said storage shelf.

13. The table of claim 9, further comprising a material of construction comprising a plurality of two (2) inch thick pressure treated lumber boards attached using corrosion-resistant fastening means.

14. A table providing a firm and stable seating means and further comprising:

a base resting on a ground surface and comprising an eight-sided configuration utilizing construction boards;

a pair of first seating assemblies attached to said base at opposing sides of said table, each further comprising a first seat assembly of parallel boards attached to said base via a pair of first vertical supports at opposing ends of said first seat assembly;

a pair of second seating assemblies attached to said base at opposing sides of said table, each further comprising a second seat assembly of parallel boards attached to said base via a pair of second vertical supports at opposing ends of said second seat assembly;

a center post attached to said base at a lower end and having an upper end, further comprising:

a sturdy vertical column secured to a plurality of supports at said lower end and a roof assembly at said upper end;

a groove extending a length of a single side of said center post to accommodate an electrical cord;

a trim piece for decoratively concealing said electrical cord and fitting in said groove;

a lower male plug mounted at a lower end of said groove at said lower end of said center post;

a pair of mounted duplex outlets mounted at opposing sides of said upper end of said center post above an upper end of said groove; and, said electrical cord routed upwardly from said male plug to said pair of mounted duplex outlets through said groove;

a tabletop attached to said base comprising an eight-sided assembly of parallel or circumscribed boards providing a flat horizontal surface;

said plurality of support means comprising an interconnected sub-structure providing a stable and secure attachment means for said pair of first seating assemblies, said pair of second seating assemblies, said center post, and said tabletop to said base by providing multiple connection points upon; and, said roof assembly mounted securely and permanently to said upper end of said center post, further comprising:

a roof extending outwardly and downwardly over said table and forming an eight-sided perimeter shape; and, a plurality of supporting roof members attached to said center post and extending in an angular arrangement outwardly to said roof;

wherein said pair of first seating assemblies and said pair of second seating assemblies each are arranged and attached to said base in such a position as to provide an access space thereby enabling a convenient approach;

wherein said access space provides easy access to elderly, encumbered, or wheelchair occupants;

wherein additional storage means is provided, thereby allowing a variety of items to be conveniently stored under or adjacent to said pair of first seating assemblies and said second seating assemblies within a perimeter of said base;

wherein said roof provides protection to occupants and said table from inclement weather.

15. The table of claim 14, further comprising:

decorative lighting mounted to said roof assembly at equidistant locations on said plurality of supporting roof members;

a cup holder comprising an eight-sided configuration having a plurality of openings for up to eight (8) cups of a standard diameter and attached at said center post at a minimal distance above said tabletop;

a storage shelf comprising an eight-sided horizontal shelf with enclosed side portions to safely contain a plurality of items and attached to and circumscribing said center post at an intermediate distance above said tabletop; and, a glass hanger comprising an eight-sided configuration with a plurality of cut-out slots for up to eight (8) pieces of stemware suitable to support said stemware hanging in an inverted orientation and attached to and circumscribing said center post at a maximal distance above said tabletop.

16. The table of claim 15, further comprising:

said base further comprises a total width in the range of and including seven (7) to ten (10) feet;

said pair of first seating assemblies comprises dimensions of approximately fifteen (15) inches deep;

said pair of second seating assemblies approximately twelve (12) inches deep;

said center post further comprises a four-by-four (4×4) inch post, a six-by-six (6×6) inch post, or an assembly of boards and extends to a height in the range of and including six (6) to ten (10) feet above said ground surface;

said tabletop comprises dimensions in the range of and including four (4) to six (6) feet in width;

said roof assembly comprises a total width in the range of and including seven (7) to ten (10) feet;

said cup holder attached to said center post at said minimal distance approximately three (3) inches above and parallel to said tabletop;

said storage shelf attached to said center post at said intermediate distance in the range of and including fourteen (14) to twenty (20) inches above and parallel to said tabletop and having said enclosed side portions approximately six (6) inches high; and, said glass hanger attached to said center post at said maximal distance approximately two (2) feet above said storage shelf.

17. The table of claim 16, further comprising a material of construction comprising a plurality of two (2) inch thick pressure treated lumber boards attached using corrosion-resistant fastening means.

* * * * *